US007877995B2

(12) United States Patent
Sandler

(10) Patent No.: US 7,877,995 B2
(45) Date of Patent: Feb. 1, 2011

(54) MACHINE TO CONVERT GRAVITY TO MECHANICAL ENERGY

(76) Inventor: Brian Peter Sandler, 5643 Putnam, West Bloomfield, MI (US) 48323

( * ) Notice: Subject to any disclaimer, the term of this patent is extended or adjusted under 35 U.S.C. 154(b) by 473 days.

(21) Appl. No.: 12/082,735

(22) Filed: Apr. 14, 2008

(65) Prior Publication Data

US 2009/0084106 A1 Apr. 2, 2009

Related U.S. Application Data

(63) Continuation-in-part of application No. 11/906,464, filed on Oct. 2, 2007, now Pat. No. 7,770,389.

(51) Int. Cl.
*F03B 17/04* (2006.01)
*F03C 1/00* (2006.01)

(52) U.S. Cl. ..... 60/496; 60/495; 290/54

(58) Field of Classification Search ..... 92/15, 92/52; 60/398, 496, 495; 290/54
See application file for complete search history.

(56) References Cited

U.S. PATENT DOCUMENTS

| | | | | |
|---|---|---|---|---|
| 4,054,031 | A * | 10/1977 | Johnson | 60/496 |
| 4,726,188 | A * | 2/1988 | Woolfolk | 60/496 |
| 5,430,333 | A * | 7/1995 | Binford et al. | 290/54 |
| 6,546,726 | B1 * | 4/2003 | Tomoiu | 60/495 |
| 2003/0145589 | A1 * | 8/2003 | Tillyer | 60/496 |
| 2006/0130475 | A1 * | 6/2006 | Yu | 60/495 |

FOREIGN PATENT DOCUMENTS

| | | | |
|---|---|---|---|
| RU | 2076243 | C1 * | 3/1997 |
| WO | WO 2007141653 | A1 * | 12/2007 |

* cited by examiner

*Primary Examiner*—Thomas E Lazo

(57) ABSTRACT

The amount of buoyancy a object has is based on the amount of liquid the object displaces, and the weight of the object. If a submersed object increases in size its buoyancy increases, and if a submersed object decreases in size its buoyancy decreases. This machine attempts to change the size/buoyancy of a submersed object using only gravity as the energy source.

3 Claims, 22 Drawing Sheets

MACHINE TO CONVERT GRAVITY TO MECHANICAL ENERGY

This is a Continuation in Part application for a invention entitled—A MACHINE TO CONVERT GRAVITY TO MECHANICAL ENERGY. Application Ser. No. 11/906,464 Filing date Oct. 2, 2007 now U.S. Pat. No. 7,770,389

BACKGROUND OF THE INVENTION

Field of Invention

The present invention relates to energy production, more particularly converting gravity to mechanical energy and/or heat.

BRIEF SUMMARY OF THE INVENTION

Machine #1

The improvements are as follows;

1. The Piston-like tanks full of liquid (1) are no longer full of liquid (11). The liquid has been replaced by a heavy metal weight (37) and gas (47).
2. The Piston-in-a-tank (21) no longer fall individually. The Piston-in-a-tank (21) now fall as a continuous column, greatly reducing the drag.
3. There is a breather tube (28), the breather tube allows more gas (47) into the expanding Piston-in-a-tank (21).
4. There are transfer solenoids (24, 25, 68) to move the rapidly moving Piston-in-a-tank (21)
5. There is a sump pump (40) and a gas valve (46) to remove any liquid (11) or gas (47) that accumulates in the Piston-in-a-tank (20,21).
6. There is a collapsible stop (26) that forces gas (47) into the Piston-in-a-tank (21).
7. There is a heat exchanger (61) and radiator (62) added.

Machine #3

The amount of buoyancy a object has is based on the amount of liquid the object displaces, and the weight of the object. If a submersed object increases in size its buoyancy increases, and if a submersed object decreases in size its buoyancy decreases. A submersed object that weights the same as the liquid it displaces will have neutral buoyancy. If the size of a object with neutral buoyancy increases the object will float-up doing work, and if the size of a object with neutral buoyancy decreases the object will sink also doing work. This machine attempts to change the size of a submersed object with neutral buoyancy using only gravity as the energy source.

BRIEF DESCRIPTION OF THE DRAWINGS

Original Machine

Machine #1

Figure 1:
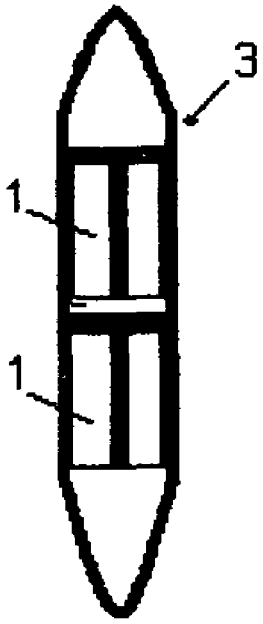
FIG. 1 is a side view of the original piston full of liquid in the un-expanded position (1).
Figure 2:
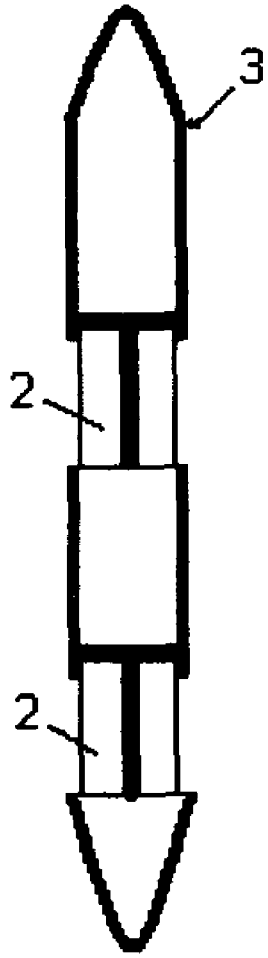
FIG. 2 is a side view of the original piston-like tank full of liquid in the expanded position (2).
Figure 3:
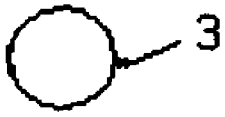
FIG. 3 is a top view of the original piston-like tank full of liquid.
Figure 4:
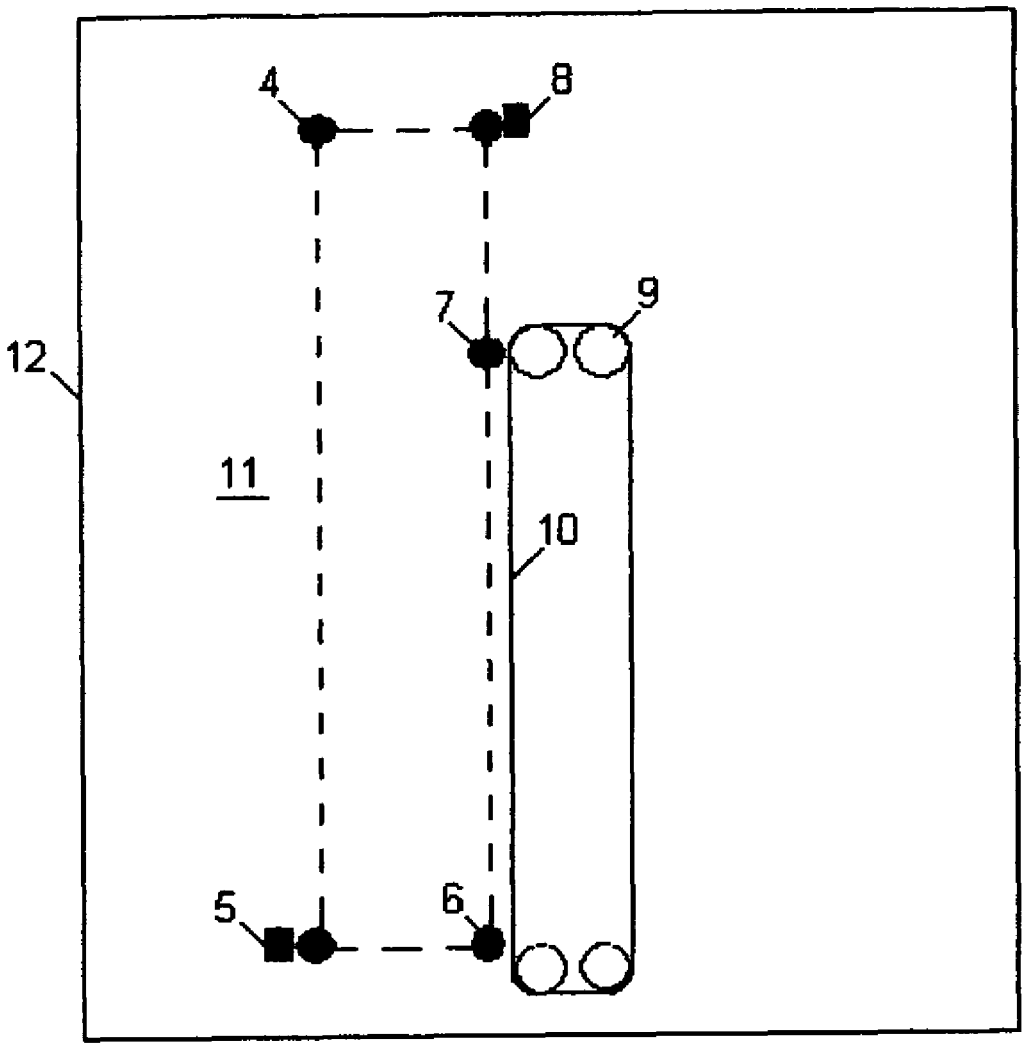
FIG. 4 is the flow chart for the original invention.
Figure 5:
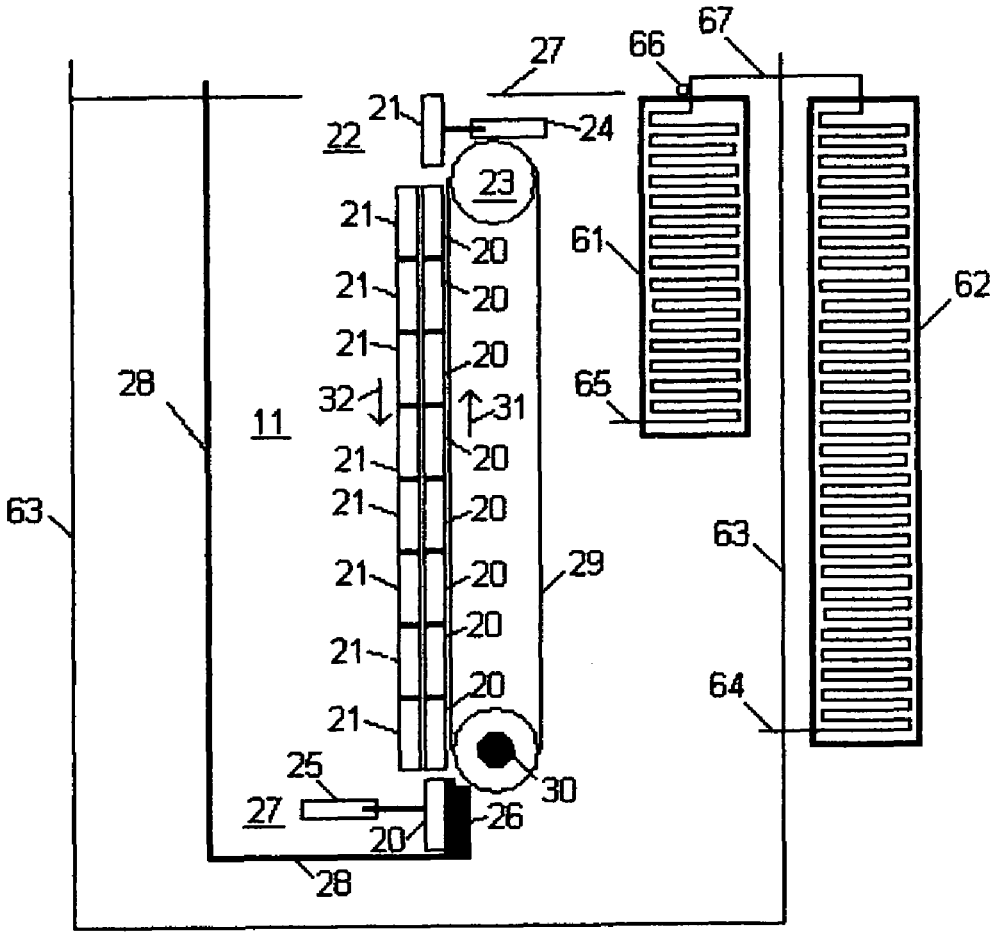

FIG. 5 is the flow-chart for the first machine.

Figure 6:
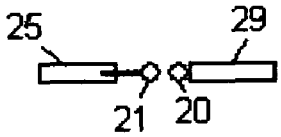

FIG. 6 is a bottom view of the flow-chart.

Figure 7:
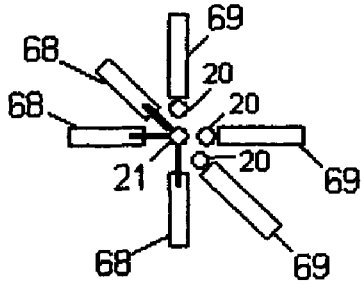

FIG. 7 is a bottom view of a flow chart. In FIG. 7 there are three transfer solenoids (68), and three (69) combination rigid track (29), generator (23), and Piston-in-a-tank (20).

Figure 8:
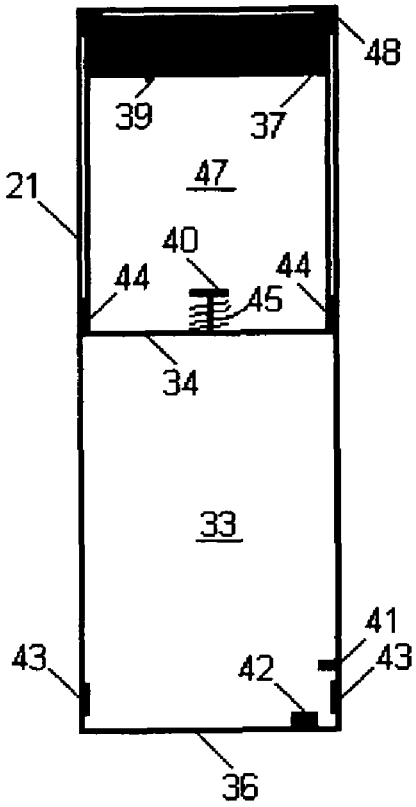

FIG. 8 is a side view of the Piston-in-a-tank (21) with the piston (34) in the up position. with the bottom door closed (36).

Figure 9:
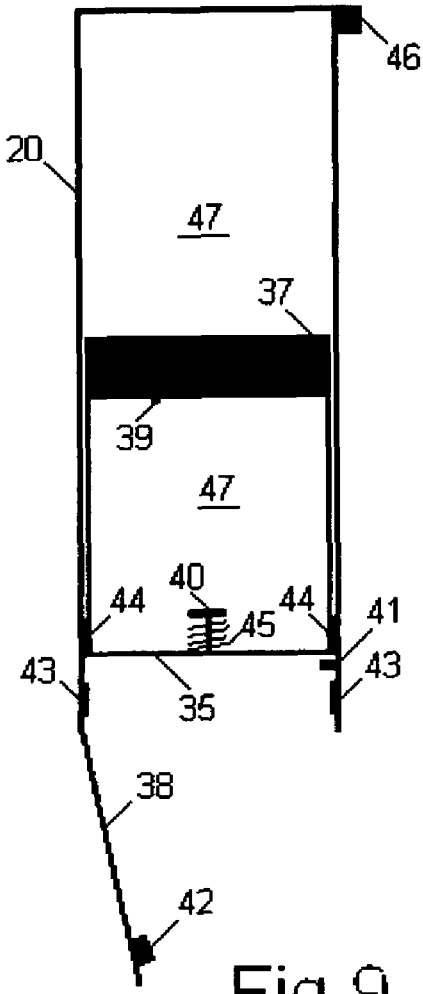

FIG. 9 is a side view of the Piston-in-a-tank (20) with the piston (35) in the down position. with the bottom door (38) open.

Figure 10:
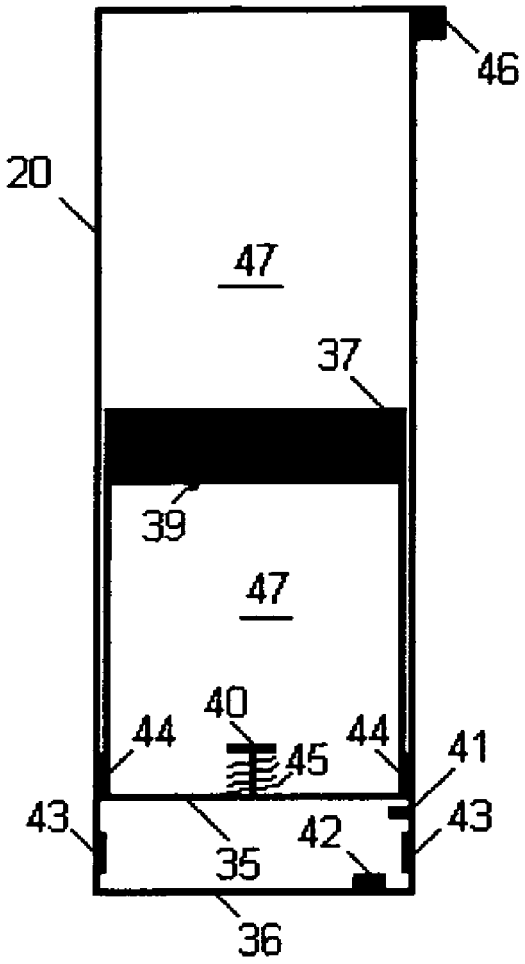

FIG. 10 is a side view of the Piston-in-a-tank (20) with the piston (35) in the down position. with the bottom door (36) closed.

Figure 11:
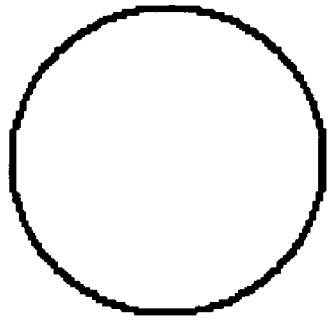

FIG. 11 is a top view of the Piston-in-a-tank (20,21). The Piston-in-a-tank are cylinders.

Figure 12:
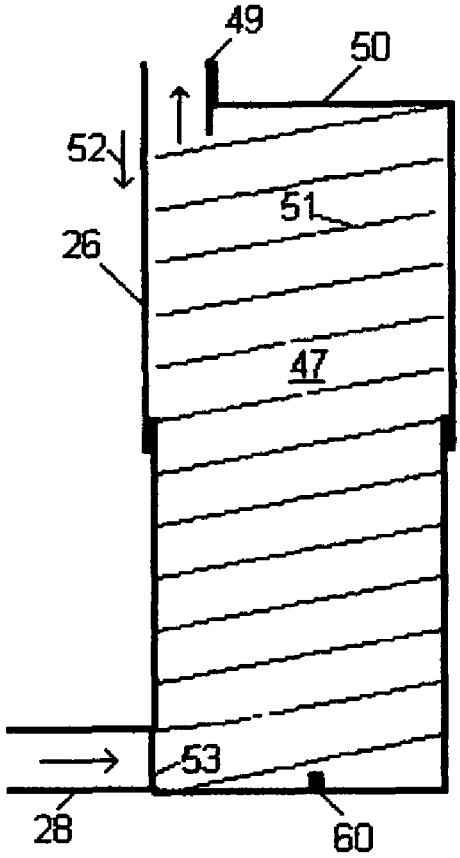

FIG. 12 is a side view of the collapsible stop in the expanded position (26).

Figure 13:
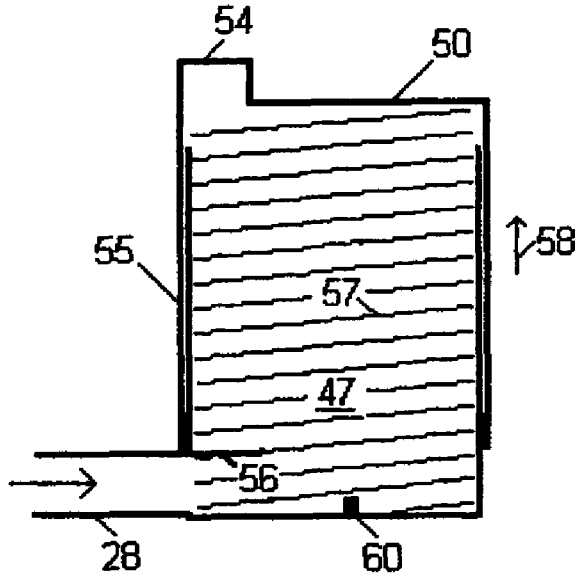

FIG. 13 is a side view of the collapsible stop in the un-expanded position (55).

Figure 14:
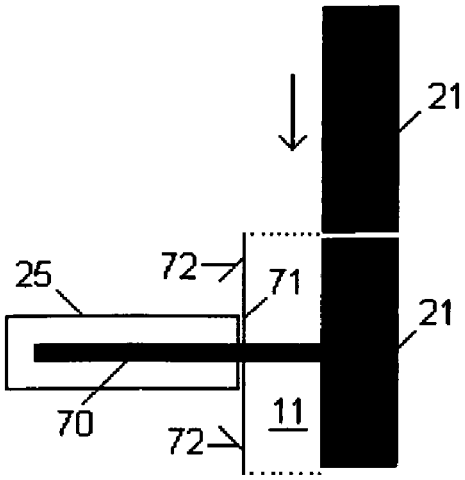

FIG. 14 is a side view of the bottom solenoid (25) in the un-extended position.

Figure 15:
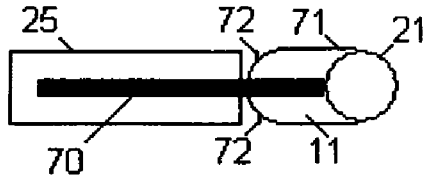

FIG. 15 is a top view of the bottom solenoid (25) in the un-extended position.

Figure 16:
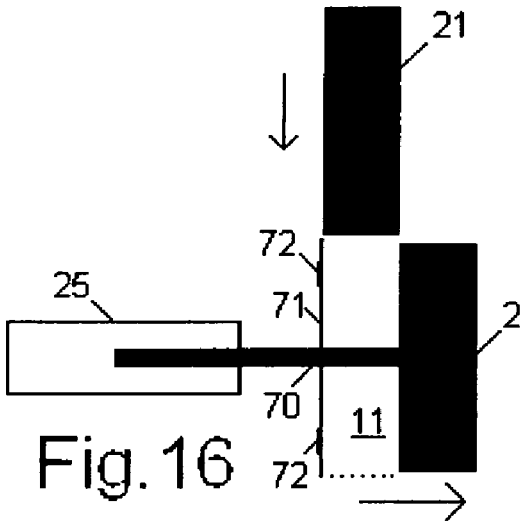

FIG. 16 is a side view of the bottom solenoid (25) in the extended position.

Figure 17:
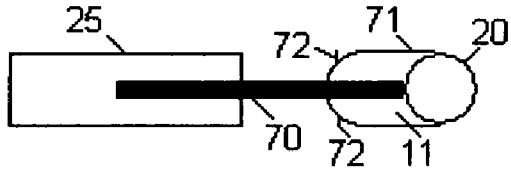

FIG. 17 is a top view of the bottom solenoid (25) in the extended position.

Figure 34:
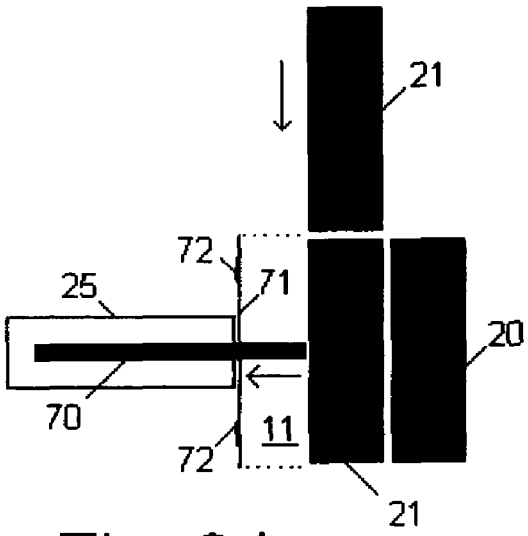

FIG. 34 is a side view of the bottom solenoid (25) in the un-extended position after it sucks the liquid (11) out of the way of the falling Piston-in-a-tank (21).

Figure 35:
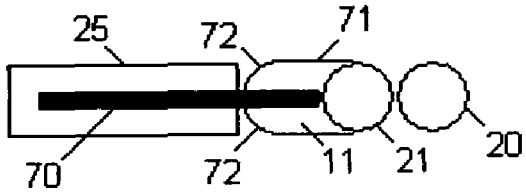

FIG. 35 is a top view of the bottom solenoid (25) in the un-extended position after it sucks the liquid (11) out of the way of the falling Piston-in-a-tank (21).

Machine #2

Figure 18:
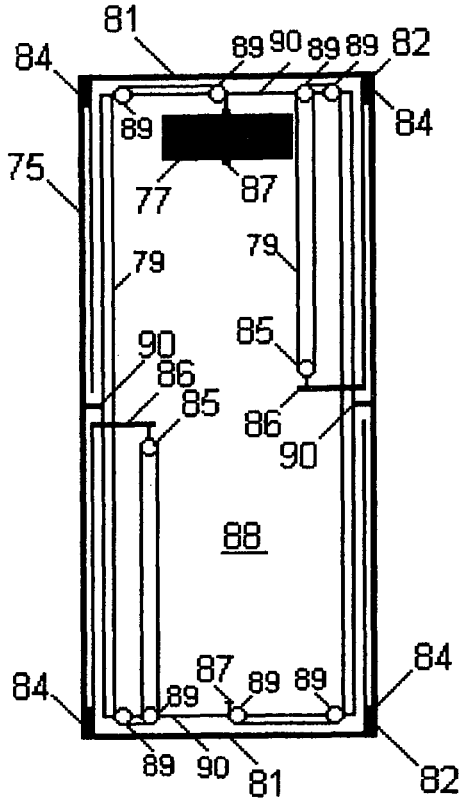

FIG. 18 is a side view of the tank (75) with the piston (81) in the un-extended position.

Figure 19:
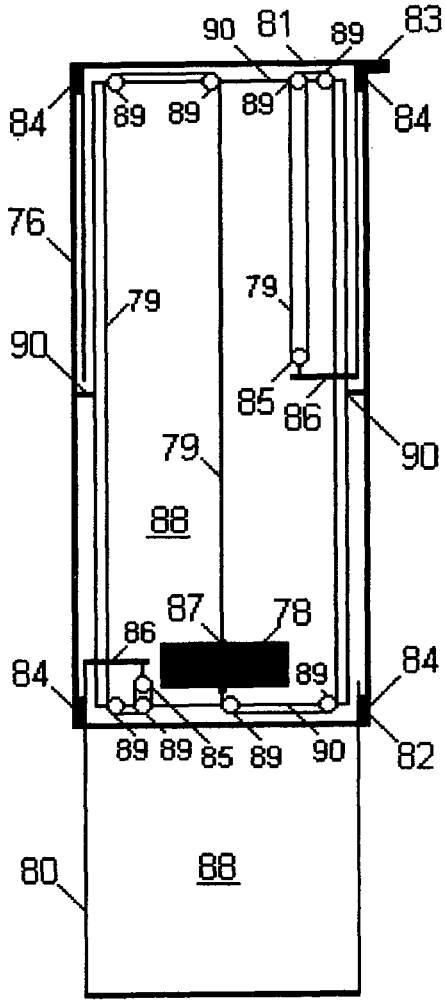

FIG. 19 is a side view of the tank (76) with the piston (80) in the extended position.

Figure 20:
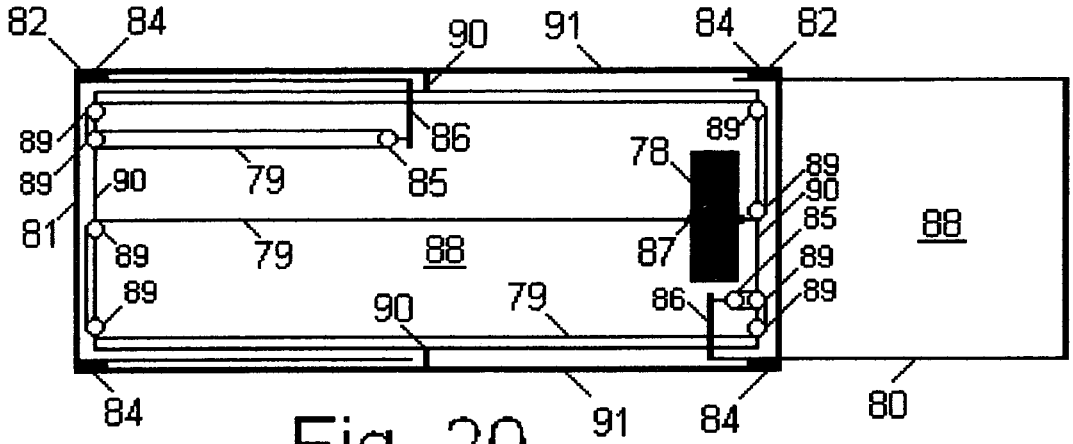

FIG. 20 is a side view of the tank (91) in the top position (93). With the piston (80) in the extended position.

Figure 21:
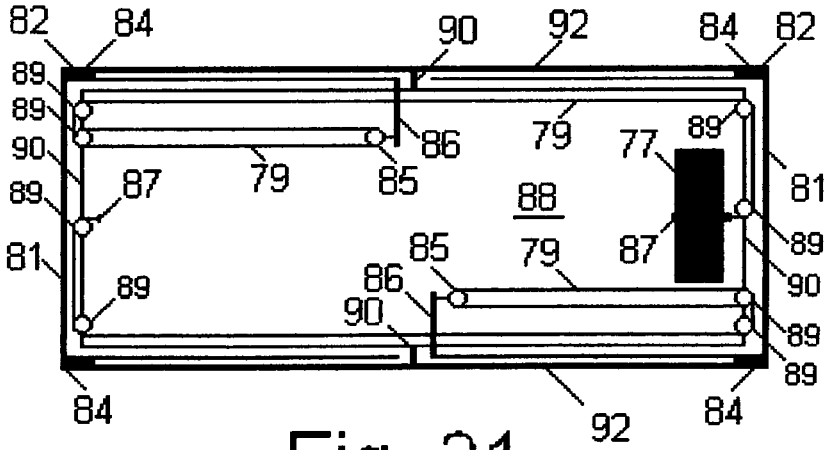

FIG. 21 is the tank (92) after it changed from tank (91) at the top position (93).

Figure 22:
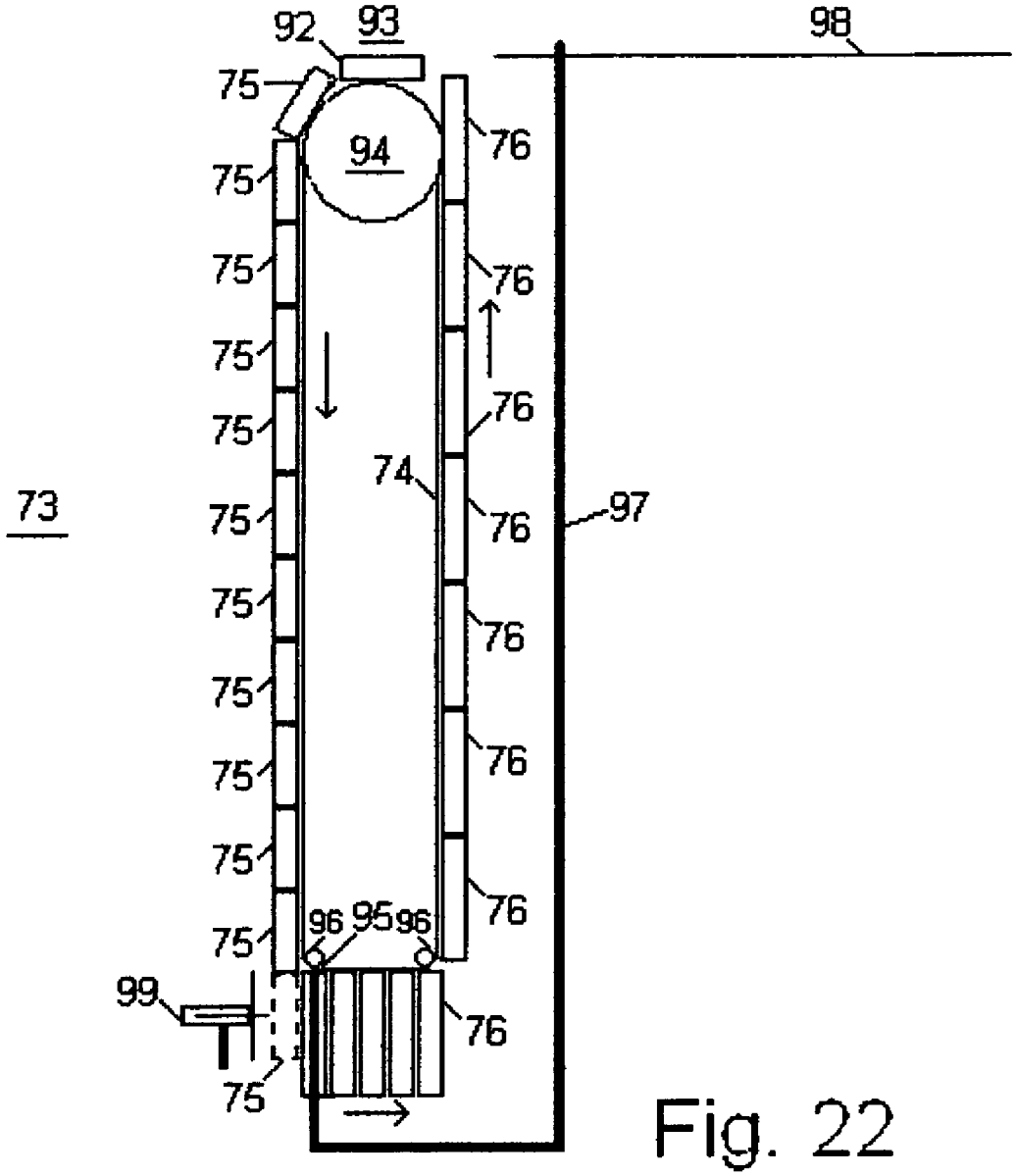

FIG. 22 is a flow-chart for the machine.

Figure 23:
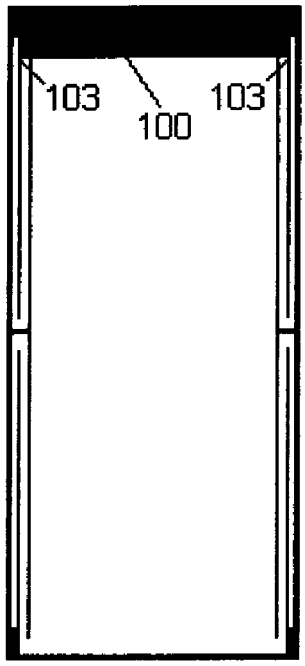
Figure 24:
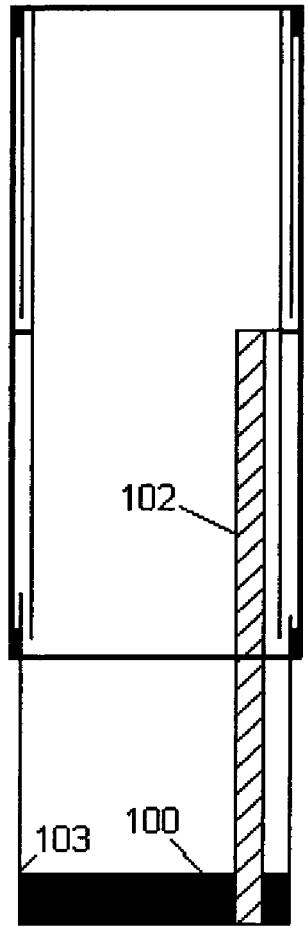

FIG. 23 is a different version of a tank. In FIG. 23 the heavy metal weight (100) extends all the way across the top of the piston. Also there are bearings (103) between the heavy metal weight and the piston FIG. 24 shows the heavy metal weight (100) falling all the way to the bottom of the extended piston. Also in FIG. 24 there is a return spring (102) for the extended piston.

Figure 25:
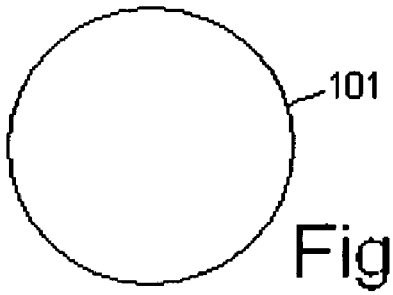

FIG. 25 is a top view of the tank (75,76). The tank (75,76) is a cylinder.

Machine #3

Figure 26:
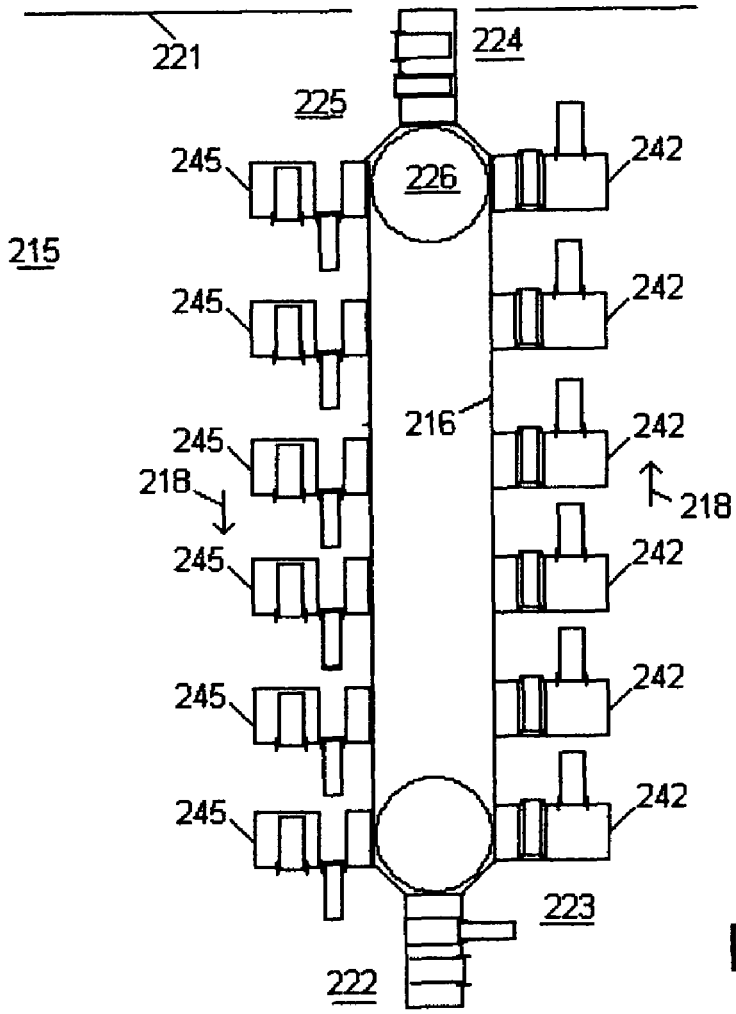

FIG. 26 is a flow-chart for the machine.

Figure 27:
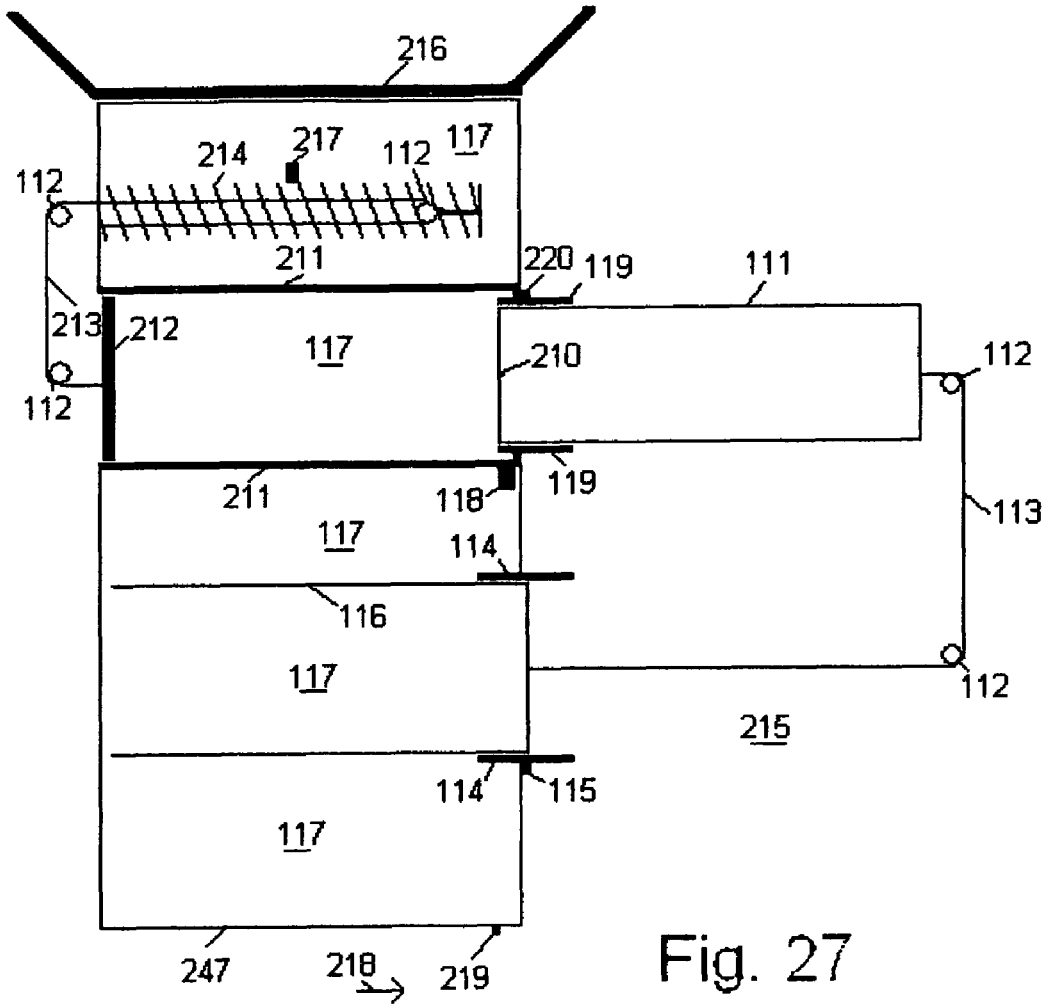

FIG. 27 is a tank-car with neutral buoyancy. The cylinder full of heavy metal (111) is extended out of the tank-car (247). The cylinder full of gas (116) is inside the tank-car (247) The piston (212) is in the starting position.

Figure 28:
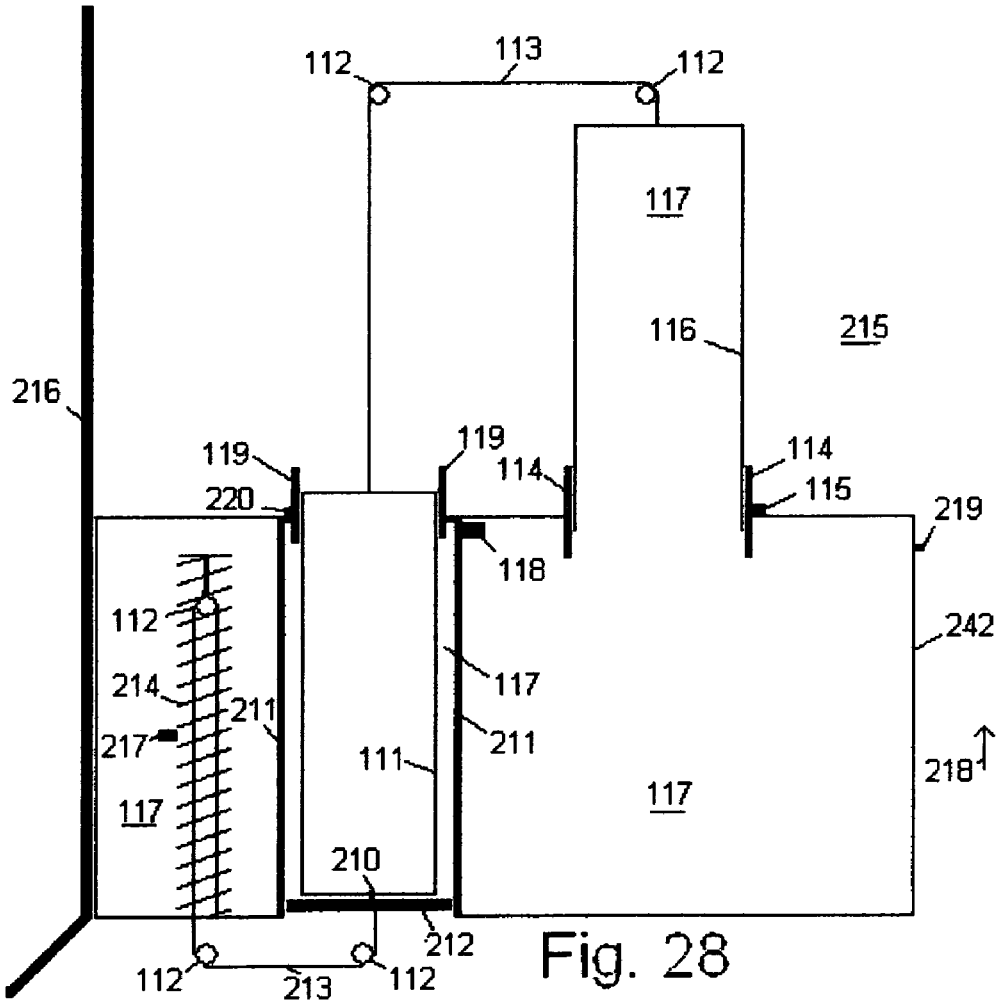

FIG. 28 is a tank-car (242) with positive buoyancy, The cylinder full of heavy Metal (111) has fallen down into the tank-car (242), pulling the cylinder full of gas (116) out of the tank-car. The cylinder full of gas (116) has greater volume than the cylinder full of heavy-metal (111).

Figure 29:
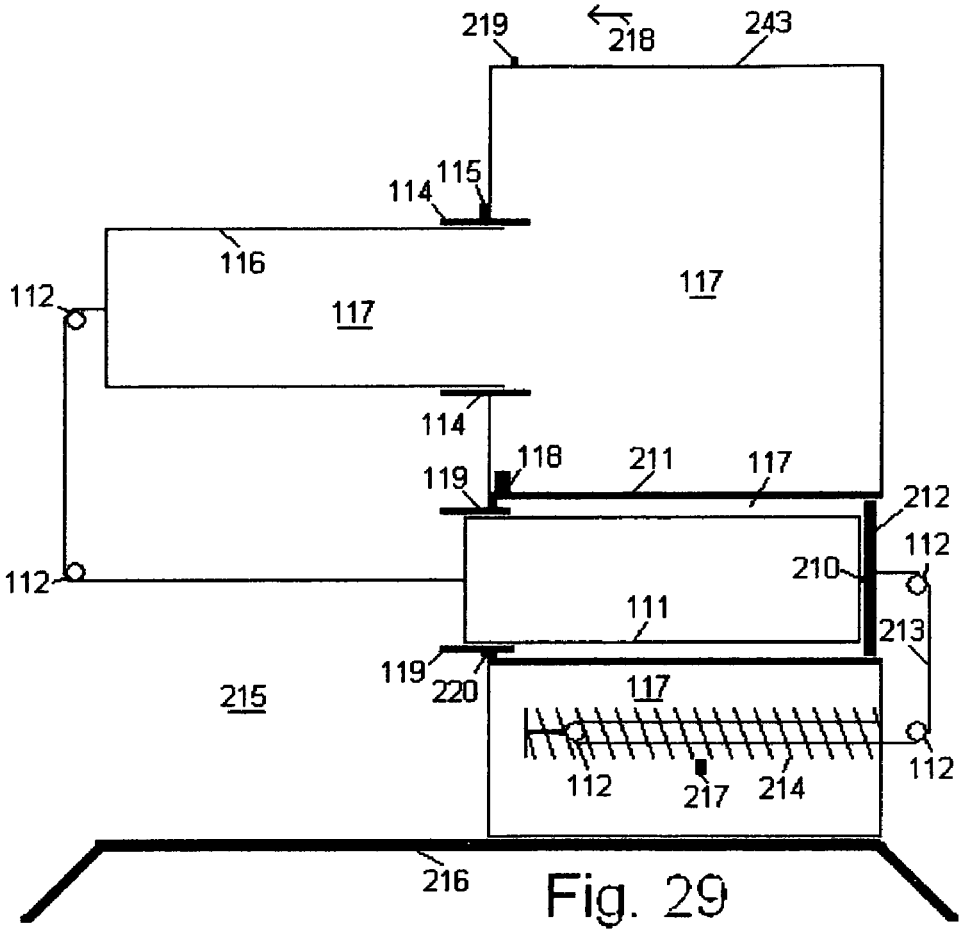

FIG. 29 is a tank-car (243) in the top position (224) on the flow-chart.

Figure 30:
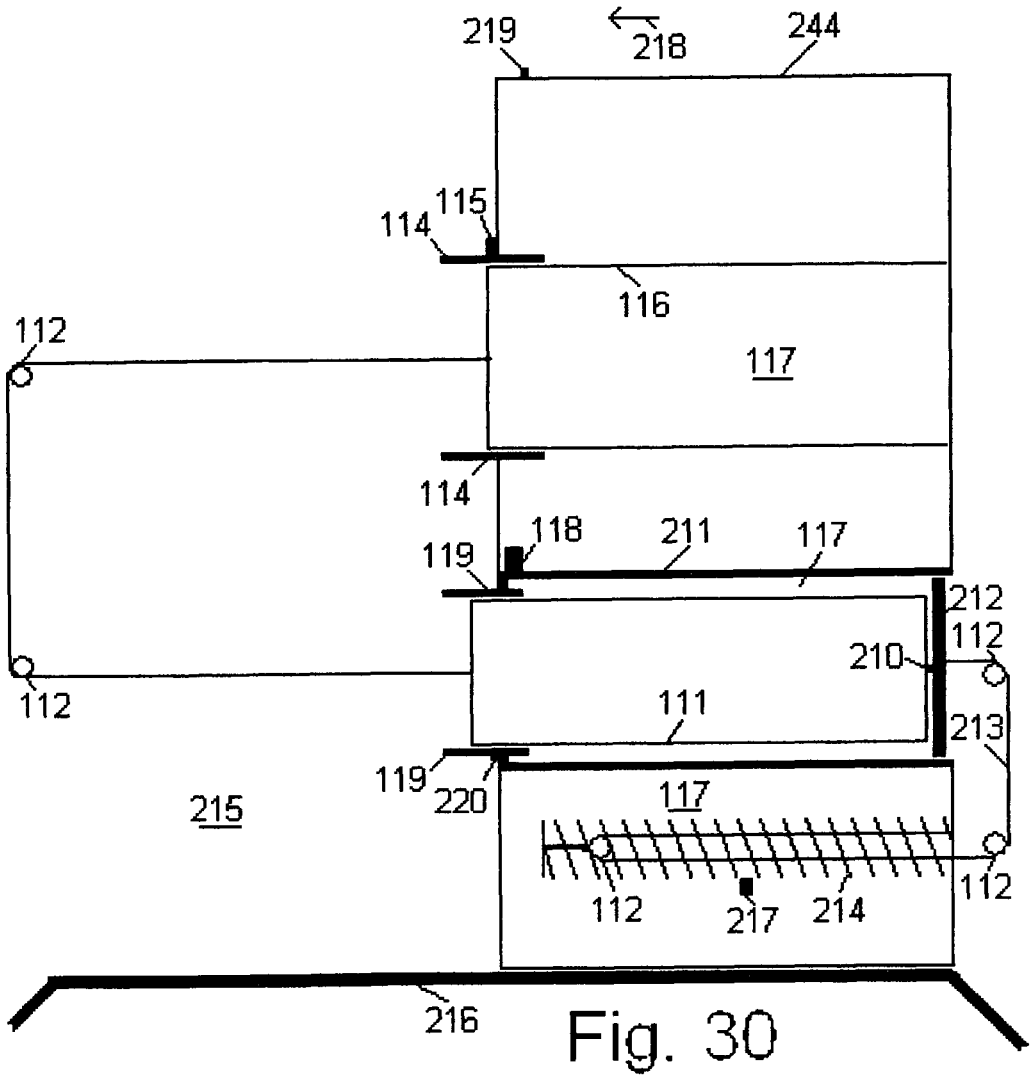

FIG. 30 is the tank-car (244) changing from positive to negative buoyancy. The cylinder full of gas (116) is now inside the tank-car.

Figure 31:
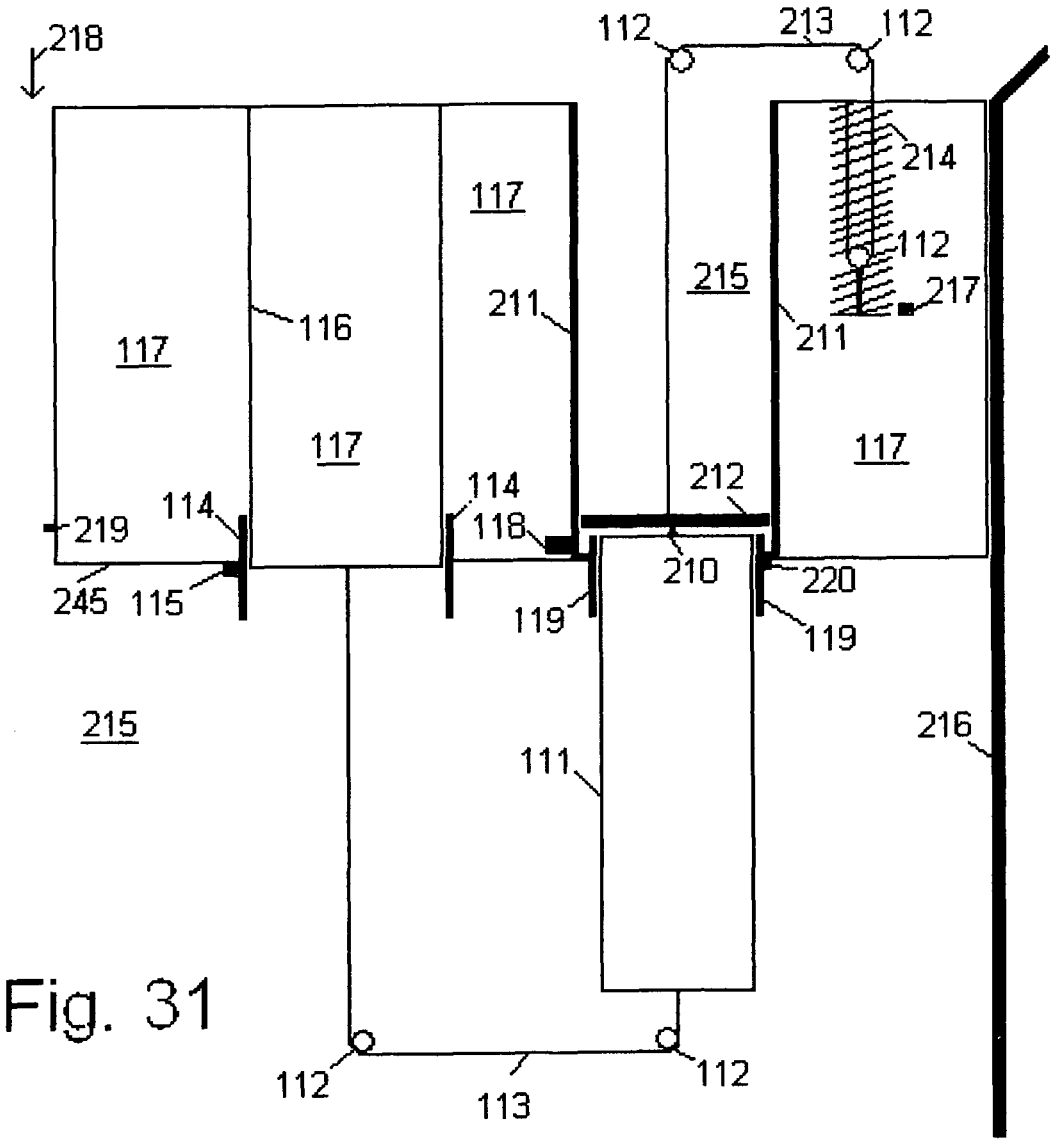

FIG. 31 is the tank-car (245) with negative buoyancy. The cylinder full of heavy Metal (111) attached to the piston (212) has fallen out of the tank-car. Spring (214) is compressed. The tank-car (245) is past (225) on the flow-chart.

Figure 32:
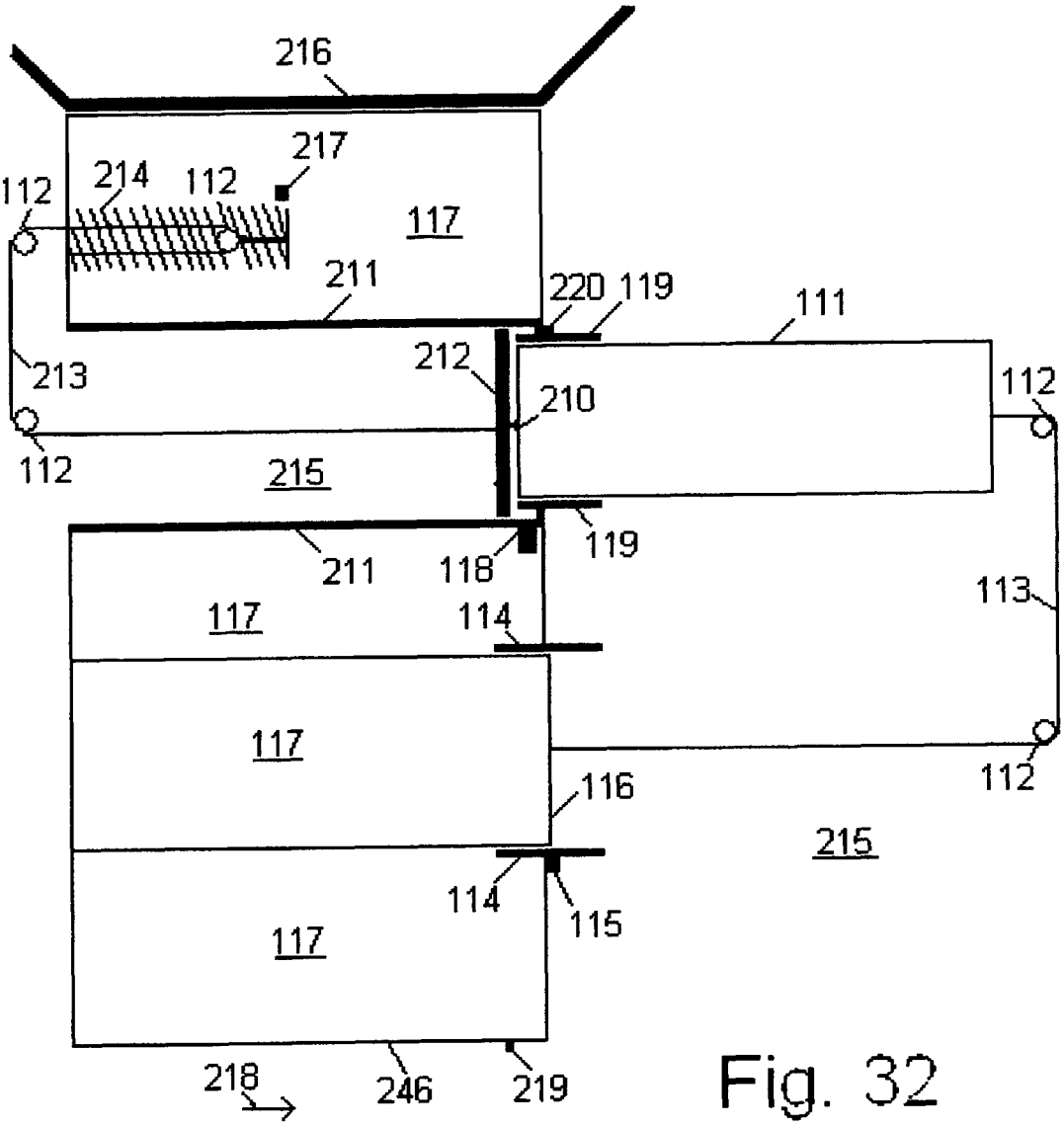
Figure 33:
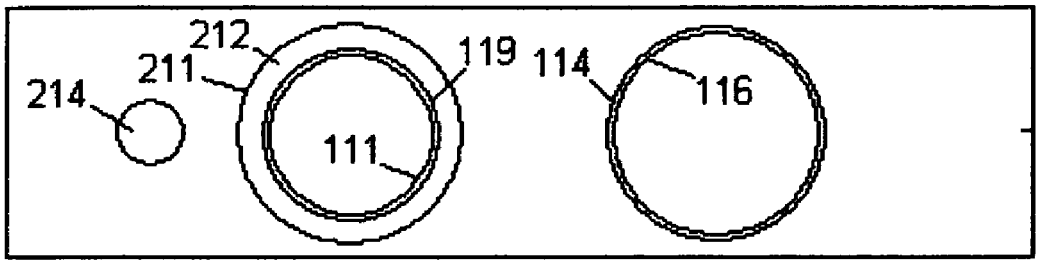

FIG. 32 is the tank-car (246) in the bottom position. (222) on the flow-chart FIG. 33 is a top view of the tank-car.

Figure 36:
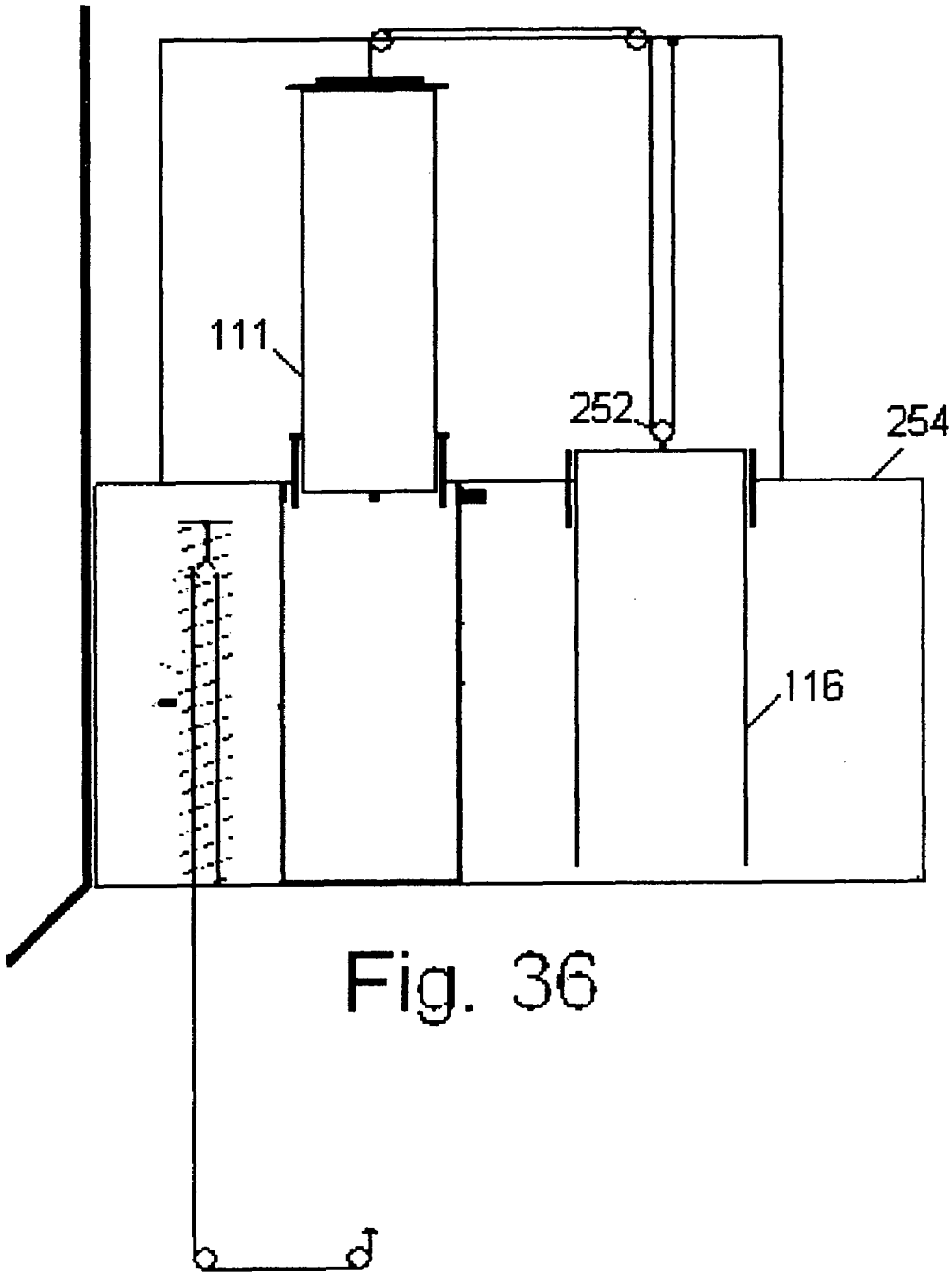
Figure 37:
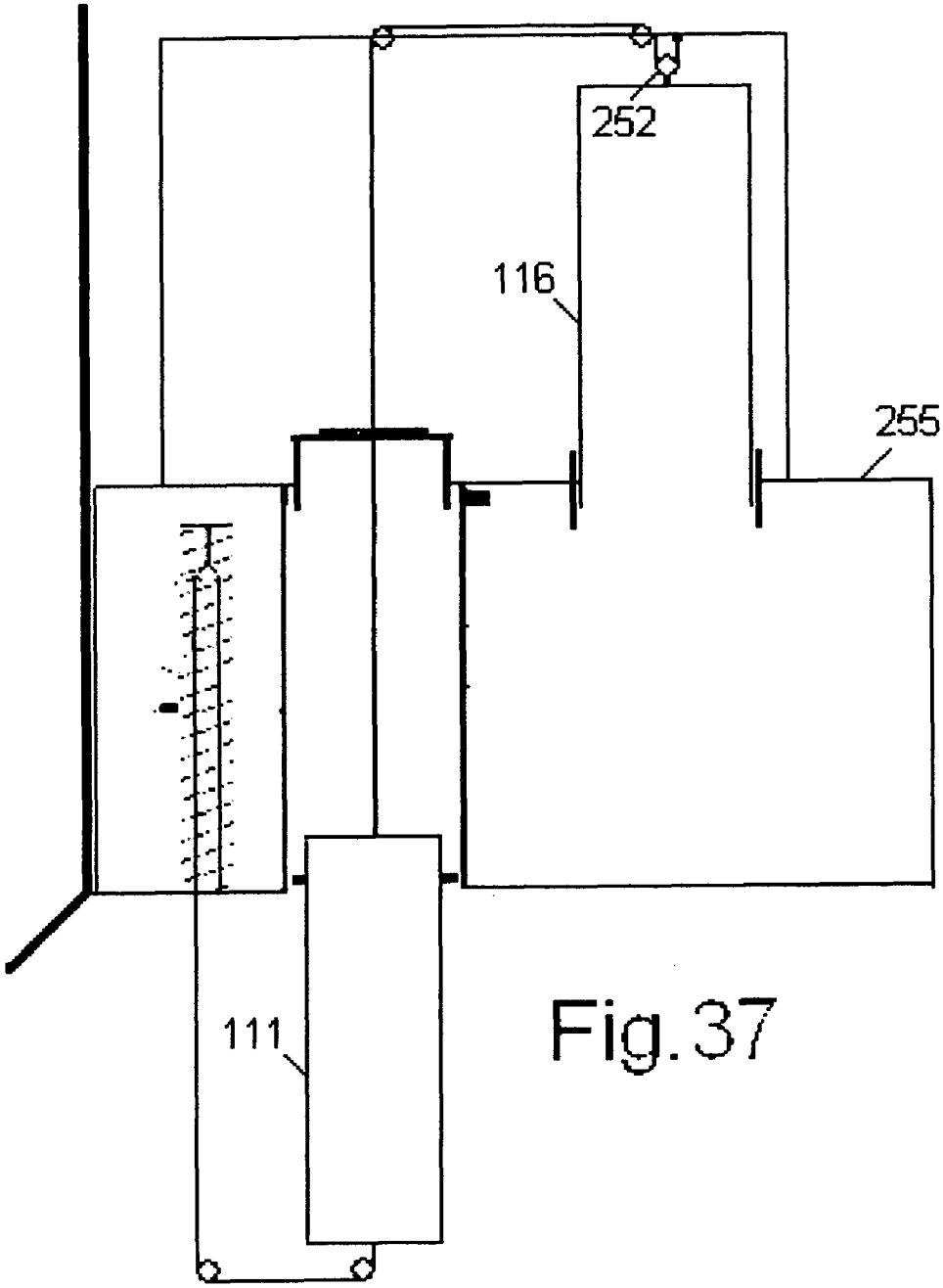

FIG. 36 and FIG. 37 are variations of machine #3.

Number 1 is a piston-like tank full of liquid (1) in the un-expanded position.

Number 2 is a piston-like tank full of liquid (2) in the expanded position.

Number 3 is a retractable stop.

Number 4 is the starting position for the original machine.

Number 5 is a stop,

Number 6 is where the piston-like tank full of liquid in the expanded position (2) attaches to the load.

Number 7 is where the piston-like tank full of liquid in the expanded position (2) is released from the load.

Number 8 is the upper stop.

Number 9 is the load.

Number 10 is the track.

Number 11 is the liquid outside the piston-like tank.

Number 12 is a large tank full of liquid (11).

Machine #1

Number 20 is the Piston-in-a-tank with the piston (35) in the down position.

Number 21 is the Piston-in-a-tank with the piston (34) in the up position.

Number 22 is the start position on the flow chart. (FIG. 5)

Number 23 is a generator.

Number 24 is the top transfer solenoid.

Number 25 is the bottom transfer solenoid

Number 26 is the collapsible stop.

Number 27 is the liquid line.

Number 28 is the gas breather tube.

Number 29 is a the rigid track.

Number 31 and 32 are arrows indicating direction of movement.

Number 33 is the liquid inside the Piston-in-a-tank (20,21).

Number 34 is the piston in the up position.

Number 35 is the piston in the down position.

Number 36 is the bottom door in the closed position.

Number 37 is the heavy metal weight.

Number 38 is the bottom door in the open position.

Number 39 is a liquid (33) passage.

Number 40 is a sump pump with a heavy metal weight.

Number 41 is a pressure equalizer valve

Number 42 is a float for the bottom door.

Number 43 are valves to let liquid (11) in.

Number 44 are cylinder walls with a seal and lock for the piston (35).

Number 45 is a return spring for the sump pump.

Number 46 is a combination retractable stop and gas valve in the extended position.

Number 47 is the gas inside the Piston-in-a-tank (20,21) and the breather tube (28) and collapsible stop (26,55).

Number 48 is a combination retractable stop and gas valve in the retracted position.

Number 49 is the top gas valve in the collapsible stop (26) in the open position.

Number 50 is the top part of the collapsible stop (26,55).

Number 51 is the return spring in the collapsible stop (26) in the extended position.

Number 52 is a arrow indicating direction of movement.

Number 53 is the bottom valve in the collapsible stop (26) in the closed position.

Number 54 is the top gas valve in the collapsible stop (55) in the closed position.

Number 55 is the collapsible stop in the collapsed position.

Number 56 is the bottom valve in the collapsible stop (55) in the open position.

Number 57 is the return spring in the collapsible stop (55) in the un-extended position.

Number 58 is a arrow indicating direction of movement.

Number 60 is a pressure powered sump pump. When the collapsible stop (26) collapses the increasing gas (47) pressure forces any liquid (11) in the collapsible stop (55) out.

Number 61 is a heat exchanger. (FIG. 5)

Number 62 is a radiator

Number 63 is a large tank

Number 64 is the return line for the radiator (62).

Number 65 is the intake line for the heat exchanger (61)

Number 66 is a pump.

Number 67 is a line from the heat exchanger (61) to the radiator (62)

Number 68 are transfer solenoids arranged in a cycle. (FIG. 7) The falling Piston-in-a-tank (21) must be removed from the bottom position and added to the top position as quickly as they fall, the rate they fall will determine the number of transfer solenoids (68) and combination rigid track (29), generator (23), and Piston-in-a-tank (20).

Number 69 is a combination rigid track (29), generator (23), and Piston-in-a-tank (20).

Number 70 is push-rod for the bottom solenoid. (25)

Number 71 is the suction cup for the bottom solenoid (25)

Number 72 are one way valves on the suction cup (71).

Machine #2

Number 73 is the liquid.

Number 74 is a rigid track.

Number 75 is the tank with the piston (81) in the un-extended position.

Number 76 is the tank with the piston (80) in the extended position

Number 77 is the heavy metal weight in the top position.

Number 78 is the heavy metal weight in the bottom position.

Number 79 is a cable that attaches the heavy metal weight (77,78) to the piston (80,81)

Number 80 is the piston in the extended position.

Number 81 is the piston in the un-extended position

Number 82 is a combination retractable stop and gas valve in the retracted position.

Number 83 is a combination retractable stop and gas valve in the extended position.

Number 84 is a combination cylinder seal and piston (80) lock.

Number 85 is a movable pulley.

Number 86 is a bracket that connects the moveable pulley (85) to the piston (80,81)

Number 87 is a connector for the cable (79) to the heavy metal weight (77,78).

Number 88 is gas.

Number 89 are pulleys for the cable (79).

Number 90 are brackets that support the pulleys (89).

Number 91 is the tank at the top position (93) on the flow-chart (FIG. 22)

Number 92 is the tank at the top position (93) on the flow-chart (FIG. 22) after the piston has returned to the un-extended position.

Number 93 is the top position on the flow-chart.

Number 94 is a generator.

Number 95 is a combination stop and gas valve on the breather tube (97).

Number 96 are pulleys for the rigid track (74).

Number 97 is a breather tube.

Number 98 is the liquid (73) line

Number 99 is the transfer solenoid.

Number 100 is a heavy metal weight extending all the way across the top and bottom of a piston.

Number 101 is a top view of the outer profile of the tank (75,76)

Number 102 is a return spring for the extended piston (80).

Machine #3

Number 111 is a cylinder full of heavy metal.

Number 112 are pulleys.

Number 113 is a cable from the cylinder full of heavy metal (111) to cylinder full of gas (116).

Number 114 is a cylinder wall with a seal.

Number 115 is a lock for the cylinder full of gas (116).

Number 116 is the cylinder full of gas.

Number 117 is the gas inside the tank-car.

Number 118 is a gas valve.

Number 119 is a cylinder wall with a seal and a lock for the cylinder full of heavy metal (111).

Number 210 is a connector for the cylinder full of heavy metal (111) to the piston (212).

Number 211 is the cylinder wall for the piston (212)

Number 212 is a piston with a seal.

Number 213 is a cable connecting the piston (212) to the spring (214).

Number 214 is a spring.

Number 215 is the liquid this machine is submersed in.

Number 216 is a rigid track

Number 217 is a stop for the spring (214) when it is compressed.

Number 218 are arrows indicating direction of movement.

Number 219 is a gas intake valve.

Number 220 is a valve that lets liquid (215) out of the tank-car.

Number 221 is a line indicating the liquid level.

Number 222, 223, 224, 225 indicate positions on the flow-chart.

Number 226 is a generator

Number 242 is the tank-car with positive buoyancy. The cylinder full of heavy metal (111) is in the tank-car, and the cylinder full of gas (116) is extended out of the tank-car.

Number 243 is the tank-car in the top position (224) on the flow chart.

Number 244 is the tank-car after it changes from positive to negative buoyancy, The cylinder full of gas (116) is now inside the tank-car.

Number 245 is the tank-car with negative buoyancy. The cylinder full of heavy metal (111) attached to the piston (212) has fallen out of the tank-car.

Number 246 is the tank-car at the bottom position (222). The piston (212) is still attached to the cylinder full of heavy metal (111).

Number 247 is the tank-car back to the starting position. The tank-car now has neutral buoyancy. The piston (212) has been released from the cylinder full of heavy metal (111)

Number 252 is a moveable pulley. FIGS. 34 and 35

Number 254 is the tank-car with the heavy metal weight (111) above the tank-car.

Number 255 is the tank-car after the heavy metal weight (111) falls thru it.

DETAILED DESCRIPTION OF THE INVENTION

Machine #1

NOTE—The liquid (11) outside the Piston-in-a-tank (20, 21) and the liquid (33) inside the Piston-in-a-tank could be water, and the heavy metal weight (37) could be lead. Water weights about 62 lbs/cubic ft. If the total displacement for the Piston-in-a-tank is 1 cubic ft, than the weight distribution would be about 60 lbs for the piston (34 and 35). Almost all the weight is in the piston. (34 and 35). The piston (34 and 35) needs to be lighter than the liquid (33) it displaces.

In the starting position the Piston-in-a-tank (20) weighs more than the liquid (11) it displaces.

The liquid (33) does not add any weight to the Piston-in-a-tank (21). END OF NOTE Starting at position 22 on the flow chart (FIG. 5) The Piston-in-a-tank (21) is heaver than the liquid (11) it displaces, The piston (34) is in the up position. The bottom area of the Piston-in-a-tank (21) is full of the liquid (33) and the bottom door (36) is closed.

The Piston-in-a-tank (21) is released from position 22 and aloud to free-fall until it gets to position 27 on the flow chart. The Piston-in-a-tank (21) fall as a continuous column greatly reducing the drag between the Piston-in-a-tank (21) and the liquid (11)

As the Piston-in-a-tank (21) fall they accelerate do to the force of gravity, both the heavy metal weight (37) and the liquid (33) in the Piston-in-a-tank (21) build momentum.

At position 27 the Piston-in-a-tank (21) is quickly pushed over to the collapsible stop (26) by the bottom transfer solenoid (25). The collapsible stop (26) abruptly stops the Piston-in-a-tank (21).

Three main things happen at position 27. One—as the collapsible stop (26) collapses it forces the gas (47) thru valve (46) into the Piston-in-a-tank (21) helping to push the piston (34) down. Two—The momentum of the liquid (33) causes it to keep going after the Piston-in-a-tank (21) is abruptly stopped. The momentum of the liquid (33) helps pull the piston (34) down. Three—The momentum of the heavy metal weight (37) causes the piston (34) to move down. The combination of the three above forces causes the Piston-in-a-tank (21) with the piston (34) in the up position to turn into the Piston-in-a-tank (20) with the piston (35) in the down position.

After the piston (35) moves down the piston locks (44) lock it in the down position. The bottom door (38) is closed by the float (42).

Just before impact between the Piston-in-a-tank (21) and the collapsible stop (26) the combination gas valve retractable stop (48) pops out. When the Piston-in-a-tank (20) starts up the retractable stop (46) goes back in the Piston-in-a-tank (20).

When the piston (34) moves down the displacement of liquid (11) increases. The Piston-in-a-tank (20) is now lighter than the liquid (11) it displaces and will float up doing work. Also at position 27 the weight on the sump pump (40) moves down and forces any liquid (11) in the Piston-in-a-tank (20) out. The return spring (45) lifts the weight after impact.

As the Piston-in-a-tank (21) falls from position 22 to position 27 the pressure on the inside and outside of the Piston-in-a-tank (21) is equalized by valve (41).

When the Piston-in-a-tank (21) impacts the collapsible stop (26) the upper valve (49) is opened and the bottom valve (53) is closed. After the Piston-in-a-tank (20) starts to float up the top valve (54) is closed and the bottom valve (56) is open. The return spring (57) returns the collapsible (55) stop to the expanded position (26). The return spring (57) must be strong enough to overcome the external pressure.

Next the Piston-in-a-tank (20) is attached to the rigid track (29) and floats up powering the generator (23). When the Piston-in-a-tank (20) gets near the top the valves (43) open to allow liquid (11) from outside in, the liquid (33) in the Piston-in-a tank (20) causes the piston (35) to float up returning the piston (35) to the up position. The Piston-in-a-tank (21) is now heaver than the liquid (11) it displaces and will sink. At the top position (22) the top transfer solenoid (24) pushes the Piston-in-a-tank (21) over and the cycle is complete. The cycle is repeated.

The bottom solenoid (25) does two things. 1) it pushes the falling Piston-in-a-tank (21) over into the collapsible stop (26). 2) It sucks the liquid (11) out of the way of the falling Piston-in-a-tank (21). When the bottom solenoid (25) changes from the extended position to the un extended position, it pulls back the suction cup (71), as the suction cup (71) is pulled back it sucks the liquid (11) out of the way of the falling Piston-in-a-tank (21).

Machine #2

In the starting position the tank (92) must weight more than the liquid (73) it displaces. Also almost all of the weight of the tank (92) is in the heavy metal weight (77).

Starting at the top position (93) the tank (92) is detached from the rigid track (74) and allowed to free fall, as the tank (75) falls its velocity and momentum increase due to the force of gravity. The tanks (75) fall in a continuous column greatly reducing the drag. The tank (75) accelerates down until it gets to the transfer solenoid (99). At the transfer solenoid (99) the tank (75) is pushed over to the combination stop and gas valve (95) and is abruptly stopped. The heavy metal weight (77) does not stop, it keeps going.

The combination of the momentum of the heavy metal weight (77) and the mechanical advantage gained from the moveable pulley (85) should be enough to move the piston (81) out of the tank (75)

As the heavy metal weight (77) falls it pulls the cable (79), as the cable (79) is pulled it causes the moveable pulley (85) to move down pulling the piston (81) out of the tank (75).

The tank (76) is now lighter than the liquid (73) it displaces and will float up doing work. Next the tank (76) is transferred over to the rigid track (74) and floats up powering the generator (94).

When the tank (91) gets to the top position (93) it changes from a tank (91) with the piston (80) in the extended position to a tank (92) with the piston (81) in the unextended position. The cable (79) is released from the heavy metal weight (78) by the cable connector (87). The external liquid ((73) pressure pushes the piston (80) back into the tank (91) A return spring (102) helps pull the piston (80) in. Also at the top position (93) any extra gas (88) is vented thru the gas valve (82). The tank (92) is now heaver than the liquid (73) it displaces and will sink. The cycle is complete. The cycle is repeated.

Note

The tanks (75) must be removed from the bottom position as quickly as they fall. Also the tanks (92) must be add to the top position (93) as quickly as they fall.

Machine #3

NOTE—The liquid (215) could be water, and the heavy metal could be lead. Water weights about 62 lbs/cubic ft. If the total displacement for the tank-car is one cubic ft. than the weight distribution would be about 60 lbs for the cylinder full of heavy metal (111), and about 2 lbs. for the rest of the tank-car. Almost all of the total weight of the tank-car is in the cylinder full of heavy metal (111).

End of Note

Starting at position (222) on the flow-chart, tank-car (247) has neutral buoyancy. The weight of the tank-car (247) equals the weight of the liquid (215) displaced. The cylinder full of heavy metal (111) is extended out of the tank-car (247) and the cylinder full of gas (116) is in the tank-car (247). The tank-car (247) is pulled along by the track (216) past the (223) position on the flow-chart. As the tank-car (247) turns and starts up, the cylinder full of heavy metal (111) starts to fall down to the inside of the tank-car (242) At this point tank-car (247) starts to turn into tank-car (242).

As the cylinder full of heavy metal (111) falls it pulls the cable (113) attached to the cylinder full of gas (116). The tank-car (242) now looks like FIG. 28. The cylinder full of gas (116) is now extended out of the tank-car (242). The volume of the liquid (215) displaced by the cylinder full of gas (116) is greater then the volume of Liquid (215) displaced by the cylinder full of heavy metal (111) increasing the total displacement of the tank-car (242). At this point the tank-car (242) weights less than the liquid (215) it displaces and floats-up doing work. Gas valve (118) allows gas (117) pressure to equalize between different parts of the tank-car (242).

Because the cylinder full of gas (116) has a larger volume than the cylinder full of heavy metal (111) the gas (117) pressure in the tank-car (242) is reduced when the cylinder full of gas (116) is removed.

Next the tank-car (242) moves to the top position (224) on the flow-chart. The stop for the cylinder full of gas (115) is released. When the tank-car (242) gets to position (224) it looks like tank-car (243) in FIG. 29. The tank-car (243) changes to tank-car (244) at position (224) on the flow-chart. The combination of the low gas (117) pressure inside the tank-car (243) and the external liquid (215) pressure causes the cylinder full of gas (116) to move back inside the tank-car (244). The valve (219) is now above the liquid line (221) any gas (117) that leaked out of the tank-car (244) will now be sucked into the low pressure and replaced. The tank-car (244) is now heavier than the liquid (215) it displaces and will sink doing work.

Next the tank-car (244) moves thru the (225) position on the flow-chart, as the tank-car (244) turns and starts to head down the cylinder full of heavy metal (111) starts to fall out pulling the piston (212) with it. As the piston (212) moves down it forces any liquid (215) that leaked into the tank-car (245) out thru the valve (220). Also as the piston (212) moves down it pulls the cable (213) and that compresses the spring (214). The volume of liquid (215) that enters the tank-car (245) when the piston (212) is pulled down is greater than the volume of the cylinder full of heavy metal (111). The tank-car (245) displaces less liquid (215) than tank-car (244) did. The tank-car (245) sinks faster. The tank-car (245) now looks like FIG. 31 Next the tank-car (245) moves past the (222) position at the bottom of the flow-chart. At this point tank-car (245) turns into tank-car (246). Next the connector (210) releases the piston (212) from the cylinder full of heavy metal (111) and the stop (217) releases the spring (214) The compressed spring (214) than pulls the piston (212) back to the starting position. As the piston (212) is pulled out of The tank-car (246) it creates a jet of liquid (215) It also creates a temporary low gas (117) pressure that helps pull-in the cylinder full of heavy metal (111) in the next cycle.

The cycle is now complete. The tank-car (247) now looks like FIG. 27 and has neutral buoyancy. The cycle is repeated.

NOTE—A variation of this machine is for the heavy metal weight (111) to fall from above the tank-car (254), thru the tank-car, and out the bottom of the tank-car. The heavy metal weight (111) would increase the displacement of the tank-car (255). Because the heavy metal weight (111) is falling further it would do more work pulling out a larger cylinder full of gas (116). Also because the heavy metal weight (111) is moving twice as far as the cylinder full of gas (116) a added moveable pulley (252) would give the heavy metal weight (111) a mechanical advantage. A breather tube is added to allow gas from the surface into the expanding tank.

I claim:

1. A machine to convert gravity to mechanical energy and heat, comprising:

a) a plurality of piston-in-a-tank with pistons that cycle between an up position (34) and an a down position (35) changing the buoyancy of the piston-in-a-tank, said piston separates the top gas tank from the liquid (11), said piston contains gas (47) and a heavy metal weight (37), said piston also contains a sump pump (40);

b) a generator (23) attached to a rigid track (29);

c) a top transfer solenoid (24) to transfer the piston-in-a-tank from the raising side to the falling side;

d) a bottom transfer solenoid (25) and its suction cup (71) to transfer the piston-in-a-tank from the falling side to the rising side and remover some of the liquid from under the falling piston-in-a-tank;

e) a combination retractable stop (48) and gas valve that suspends the falling piston-in-a-tank and allows gas from the surface into the expanding piston-in-a-tank;

f) a gas breather tube (28) to transfer gas from the surface to the expanding piston-in-a-tank;

g) a door (38) at the bottom of the piston-in-a-tank, said door has a float (42) to close it;

h) a pressure equalizing valve (41), said valve allows pressure to equalize as the piston-in-a-tank fall;

i) valves to let liquid in (43), said valves open when the piston-in-a-tank is near the top allowing the piston to float from the bottom to the top of the piston-in-a-tank;

j) cylinder walls (44) with a seal and lock, said lock holds the piston in the down position after impact;

k) a heat exchanger (61) and radiator (62), said heat exchanger removes excess heat from the liquid;

wherein the machine is immersed in a body of liquid;

wherein at position (22) the piston-in-a-tank are released and allowed to free-fall to the position (27);

wherein as said piston-in-a-tank falls the pressure on the inside and outside of said piston-in-a-tank is equalized by valve (41);

wherein the piston-in-a-tank fall as a continuous column greatly reducing the drag between the piston-in-tank and the liquid;

wherein as the piston-in-a-tank fall they accelerate do to the force of gravity, both the heavy metal weight and the liquid in said piston-in-a-tank build momentum;

wherein at position (27) said piston-in-a-tank is quickly pushed over to the collapsible stop (26) by the bottom transfer solenoid and just before impact the combination gas valve and retractable stop (48) pops out, valve (49) is open, valve (53) is closed;

wherein said collapsible stop abruptly suspends the fall of said piston-in-a-tank;

wherein as the collapsible stop collapses it forces the gas thru valve (46) into said piston-in-a-tank helping to push the piston (34) down, and the momentum of said liquid and said heavy metal weight move the said piston down;

wherein the sump pump with a heavy metal weight (40) moves down and forces any liquid in said piston-in-a-tank out;

wherein the piston lock (44) locks said piston in the down position, and the bottom door (38) is closed by float (42);

wherein the piston-in-a-tank becomes lighter than the liquid it displaces and will float up doing work;

wherein the valve (54) closes, valve (56) opens, and the return spring (57) returns the collapsible stop to the expanded position (26);

wherein the piston is attached to the rigid track (29) and floats up powering a generator (23);

wherein the piston-in-a-tank near the top valves (43) open to allow liquid from the outside in;

wherein the piston floats up, returning said piston to the up position;

wherein the piston-in-a-tank becomes heaver then the liquid it displaces and will sink;

wherein at position (22) the top transfer solenoid (24) pushes the piston-in-a-tank over and the cycle becomes complete;

wherein the cycle is repeated.

2. A machine to convert gravity to mechanical energy, comprising:

a) a plurality of tanks with pistons that cycle between an extended position (80) and an un-extended position (81) said pistons also separate the gas (88) in the tanks from the liquid (73) outside the tanks;

b) a heavy metal weight (77), said heavy metal weight moves inside the tank;

c) a cable (79);

d) a moveable pulley (85), said moveable pulley gives the heavy metal weight a mechanical advantage as it falls;

e) a combination cylinder seal and piston lock (84);

f) a bracket (86), said bracket attaches the moveable pulley to the piston;

g) a connector (87);

h) a series of pulleys (89), said pulleys guide the cable (79);

i) a bracket (90), said bracket supports the pulleys (89);

j) a generator (94);

k) a combination stop and gas valve (95) on the breather tube (97);

l) a rigid tract (74), said tract having pulleys (96) to support it:

m) a transfer solenoid (99)

wherein the machine is immersed in a body of liquid;

wherein some tanks fall in a continuous column with the piston in the un-extended position;

wherein some tanks float up with the piston in the extended position to move the tract;

wherein the tanks with the piston in the un-extended position are detached from the rigid tract at position (93) and free fall;

wherein the velocity and momentum of said tanks increases due to the force of gravity;

wherein said tanks fall in a continuous column greatly reducing the drag on said tanks;

wherein said tanks fall to the transfer solenoid (99);

wherein said transfer solenoid pushes said tank over to the combination stop and gas valve (95) on the breather tube, said transfer solenoid moves said tanks as quickly as they fall, said breather tube and gas valve allow gas from the surface into the expanding tank;

wherein the combination retractable stop and gas valve (83) becomes extended;

wherein the fall of the tank is suspended;

wherein the heavy metal weight continues to fall;

wherein the combination of the momentum of the heavy metal weight falling and the mechanical advantage from the moveable pulley (85) move the piston out of the tank;

wherein the combination cylinder seal and piston lock (84) lock said piston in the extended position;

wherein the tank becomes lighter than the liquid (73) it displaces and will float up doing work;

wherein the expanded tank is attached to the rigid tract (74) and floats up to the position (93);

wherein the cable (79) is released from the heavy metal weight at the connector (87);

wherein the external liquid pressure pushes the piston into the tank, extra gas (88) inside the tank is vented thru the combination retractable stop and gas valve (82) said tank is now heavier than the liquid it displaces and will sink in the next cycle;

wherein as the tank passes the number (93) position it flips putting the heavy metal weight on top of said tank, ready for the next cycle, the cycle is complete;

wherein the moving rigid track powers a generator (94).

3. A machine to convert gravity to mechanical energy, comprising:

a) a plurality of tank-cars with a cylinder full of metal (111) and a cylinder full of gas (116) and a piston with a seal (212) that cycle between a tank-car with positive buoyancy (242) and a tank-car with negative buoyancy (245), said cylinder full of heavy metal, cylinder full of gas and piston with a seal separate the gas (117) inside the tank-car and the liquid (215) outside the tank-car;

b) a cable (113), said cable connects said cylinder full of heavy metal with said cylinder full of gas;

c) pulleys (112), said pulleys support said cable (113);

d) a cylinder wall with a seal (114), for the cylinder full of gas;

e) a lock (115);

f) a gas valve (118) said gas valve allows gas pressure to equalize between different parts of said tank-car;

g) a cylinder wall with a seal and a lock (119) for the cylinder full of heavy metal;

h) a connector (210);

i) a cylinder wall (211) for the piston with a seal (212);

j) a cable (213), said cable goes from the piston with a seal (212) thru the pulleys (112) and compresses a spring (214);

k) a spring (214);

l) a rigid tract (216);

m) a stop (217);

n) a gas intake valve (219);

o) a valve (220);

p) a generator (226);

q) a moveable pulley (252)

wherein the plurality of tank-cars are attached to a track (216);

wherein the machine is immersed in a body of liquid;

wherein some tank-cars with the cylinder full of gas extended out of the tank-car and the heavy metal weight in the tank-car float up, while some tank-cars with the cylinder full of gas in the tank-car and the heavy metal weight extended out of the tank-car sink;

wherein starting at position (222) the tank-car has neutral buoyancy, the cylinder full of heavy metal is extended out of the tank-car and the cylinder full of gas is in the tank-car;

wherein the tank-car is pulled along by the track past the position (223);

wherein the tank-car turns and starts up;

wherein the cylinder full of heavy metal falls pulling the cable (113) that is attached to the cylinder full of gas, the cylinder full of gas becomes extended from the tank-car;

wherein the tank-car becomes lighter than the liquid it displaces and will float up doing work;

wherein gas valve (118) allows gas pressure to equalize between different parts of the tank-car;

wherein the gas pressure in the tank-car becomes reduced;

wherein the tank-car moves to the top position (224);

wherein the lock (115) for the cylinder full of gas is released;

wherein the combination of low gas pressure inside the tank-car and the external liquid pressure causes the cylinder full of gas to move back inside the tank-car;

wherein valve (219) becomes above the liquid line (221) allowing any gas that leaked out of the tank-car to be replaced;

wherein the tank-car becomes heavier than the liquid it displaces and will sink doing work;

wherein the tank-car passes position (225) and turns to head down;

wherein the cylinder full of heavy metal falls out of said tank-car pulling the piston with a seal (212) with it, and as said piston with a seal moves down it forces any liquid that leaked into said tank-car out thru valve (220);

wherein as the piston with a seal moves down it pulls the cable (213) and that compresses the spring (214);

wherein after the piston with a seal is pulled down the tank-car will displace less liquid and sink faster;

wherein the tank-car moves past the (222) position;

wherein the connector (210) releases the piston with a seal from the cylinder full of heavy metal and the stop (217) releases the spring (214);

wherein the compressed spring pulls the piston with a seal back to the starting position;

wherein as the piston with a seal is pulled out of the tank-car it creates a jet of liquid, and a temporary low gas pressure that helps pull in the cylinder full of heavy metal in the next cycle;

wherein the cycle is complete;

wherein in a variation of this machine the heavy metal weight falls from above the tank-car thru said tank-car and out the bottom of said tank-car, and a moveable pulley (252) is added to pull the cylinder full of gas out of said tank-car, said movable pulley giving said heavy metal weight a mechanical advantage over said cylinder full of gas;

wherein the moving track powers a generator (225).

* * * * *